US008511791B2

(12) United States Patent
Tsuchiya

(10) Patent No.: US 8,511,791 B2
(45) Date of Patent: Aug. 20, 2013

(54) LIQUID EJECTING APPARATUS

(75) Inventor: Kenji Tsuchiya, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/343,647

(22) Filed: Jan. 4, 2012

(65) Prior Publication Data

US 2012/0169809 A1 Jul. 5, 2012

(30) Foreign Application Priority Data

Jan. 5, 2011 (JP) ..... 2011-000392
Jan. 5, 2011 (JP) ..... 2011-000393

(51) Int. Cl.
*B41J 2/165* (2006.01)

(52) U.S. Cl.
USPC ..... 347/22

(58) Field of Classification Search
USPC ..... 347/22
See application file for complete search history.

(56) References Cited

U.S. PATENT DOCUMENTS 5,699,092 A * 12/1997 Kawakami et al. ..... 347/30
6,846,061 B2 * 1/2005 Nakashima ..... 347/22

FOREIGN PATENT DOCUMENTS

JP 2007-283658 11/2007

* cited by examiner

*Primary Examiner* — Matthew Luu
*Assistant Examiner* — Alexander D Shenderov
(74) *Attorney, Agent, or Firm* — Workman Nydegger

(57) ABSTRACT

The present invention relates to a liquid ejecting apparatus including a liquid ejecting head including a plurality of nozzles that eject a liquid, a liquid receiving unit that receives the liquid that is ejected from the nozzles on the liquid ejecting head while having a deformable sheet-like member fixed thereto, and a deforming unit that deforms the sheet-like member.

11 Claims, 7 Drawing Sheets

LIQUID EJECTING APPARATUS

The entire disclosure of Japanese Patent Application Nos. 2011-000392, filed Jan. 5, 2011 and 2011-000393, filed Jan. 5, 2011 are expressly incorporated by reference herein.

BACKGROUND

1. Technical Field

The present invention relates to a liquid ejecting apparatus.

2. Related Art

In the past, as a liquid ejecting apparatus that ejects ink drops from nozzles on an ink jet head onto recording paper (medium), an ink jet printer (hereinafter, referred to as a "printer") has been common. In such a printer, in order to maintain or recover the ejecting characteristics of the nozzles on the ink jet head, a flushing process of ejecting ink from the nozzles at a different location from the recording paper is performed (for example, refer to JP-A-2007-283658).

However, with the technique of the related art described in JP-A-2007-283658, since a cleaning mechanism for cleaning a porous body using a cleaning liquid is needed in order to prevent waste ink from accumulating on the porous body provided within the flushing box, there was a problem that the apparatus configuration became complicated. Further, since the porous body is washed using a cleaning liquid, there was a problem that there was the need to frequently change the waste liquid tank in which the waste liquid after the cleaning is deposited.

SUMMARY

An advantage of some aspects of the invention is that a liquid ejecting apparatus that can prevent the deposition of waste ink is provided.

In order to solve the above problem, a liquid ejecting apparatus according to an aspect of the invention includes: a liquid ejecting head that includes a plurality of nozzles that eject a liquid; a liquid receiving unit that receives the liquid that is ejected from the nozzles on the liquid ejecting head while having a deformable sheet-like member fixed thereto; and a deforming unit that deforms the sheet-like member.

According to the liquid ejecting apparatus according to the aspect of the invention, it is possible to remove the liquid that is attached to the sheet-like member by the deforming unit deforming the sheet-like member. Further, even in a case when the liquid that is attached to the sheet-like member solidifies and a solidified film is produced, the solidified film can be detached from the sheet-like member by the deforming unit deforming the sheet-like member and breaking the solidified film. It is therefore possible to remove the liquid from the sheet-like member, and it is possible to prevent the occurrence of an inconvenience in which the liquid solidifies and accumulates on the sheet-like member.

Further, in the liquid ejecting apparatus, it is preferable that the deforming unit change the shape of the sheet-like member when the sheet-like member receives the liquid.

With such a configuration, it is possible to change the state of the liquid that is attached to the sheet-like member by changing the shape from the shape when the sheet-like member receives the liquid, and it becomes possible to remove the liquid or to remove the solidified materials of the liquid.

Furthermore, in the liquid ejecting apparatus, it is preferable that the deforming unit deform the sheet-like member from the opposite side to the face in which the sheet-like member receives the liquid to a direction of the face side that receives the liquid.

With such a configuration, by increasing the deforming amount of the attached liquid, it becomes possible to wash away the liquid or to remove the solidified materials of the liquid.

Furthermore, in the liquid ejecting apparatus, it is preferable that the deforming unit include an abutting portion that abuts from the opposite side to the face in which the sheet-like member receives the liquid.

With such a configuration, it is possible to easily deform the sheet-like member by the abutting portion abutting the sheet-like member.

Furthermore, in the liquid ejecting apparatus, it is preferable that by the abutting portion abutting the sheet-like member, cracks be caused in solidified materials of the liquid that is attached to the sheet-like member.

With such a configuration, cracks are caused by increasing the deforming amount of the solidified materials of the liquid that is attached, and the solidified materials are removed by making the solidified materials easily detachable from the sheet-like member.

Furthermore, in the liquid ejecting apparatus, it is preferable that the deforming unit make the amount by which the sheet-like member is deformed changeable, and in a case when the amount of time after the sheet-like member receives the liquid is long, the deforming amount of the sheet-like member be increased.

With such a configuration, since the deforming amount of the sheet-like member is increased in a case when the amount of time after the sheet-like member receives the liquid is long, it is possible to reliably detach and remove the solidified materials from the sheet-like member.

Furthermore, in the liquid ejecting apparatus, it is preferable that the deforming unit include a lever unit in which one end portion can abut when the liquid ejecting head is moved, and when the lever unit moves to a second position that is different from a first position in which the liquid ejecting head ejects the liquid from the nozzles to the liquid receiving unit, the abutting portion that is positioned at the other end portion deform the sheet-like member.

With such a configuration, it is possible to realize a configuration of deforming the sheet-like member in synchronization with the movement of the liquid ejecting head.

Furthermore, in the liquid ejecting apparatus, it is preferable that the deforming unit deform the abutting position of the sheet-like member with the abutting portion.

With such a configuration, it is possible to remove the liquid on the sheet-like member efficiently by changing the deforming position.

Furthermore, the liquid ejecting apparatus according to an aspect of the invention may further include a pressure changing unit that deforms the sheet-like member by changing the pressure of the opposite face side that is opposite to the ejection face to which the liquid is ejected in the sheet-like member.

According to the liquid ejecting apparatus according to the aspect of the invention, it is possible to remove the liquid that is attached to the sheet-like member by the pressure changing unit deforming the sheet-like member. Further, even in a case when the liquid that is attached to the sheet-like member is solidified and a solidified film is created, the solidified film is broken and detached from the sheet-like member by the pressure changing unit deforming the sheet-like member. It is therefore possible to remove the liquid from the sheet-like member without performing a cleaning process of the sheet-like member, and it is possible to prevent the occurrence of an inconvenience in which the liquid solidifies and accumulates on the sheet-like member.

Furthermore, in the liquid ejecting apparatus, it is preferable that the pressure changing unit pressurize or atmospherically release a pressurized space that is formed by the sheet-like member and the liquid receiving unit.

With such a configuration, since the space created by the sheet-like member and the liquid receiving unit is pressurized or atmospherically released, it is possible to favorably deform the sheet-like member.

Furthermore, in the liquid ejecting apparatus, it is preferable that a communicating portion that leads pressurized air of the pressurized space to the ejection face of the sheet-like member be formed on the liquid receiving unit, and a communicating portion valve that can open and close the communicating portion be provided on the communicating portion. In addition, it is preferable that a pump that pressurizes the pressurized space, a supply unit that supplies pressurizing force from the pump to the pressurized space, and a supply valve that can open and close the supply unit be further provided, wherein after pressurizing the pressurized space by releasing the supply unit valve and driving the pump in a state in which the communicating unit valve is closed, the supply valve is closed and the communicating portion valve is released.

In such a manner, by releasing the communicating portion valve after deforming the sheet-like member by supplying a pressurized fluid to the space, for example, the pressurized fluid within the sealed space can be ejected from the communicating portion toward the ejection face of the sheet-like member. Accordingly, it is possible to reliably remove the liquid from the surface of the sheet-like member by blowing away the liquid remaining on the surface of the sheet-like member.

BRIEF DESCRIPTION OF THE DRAWINGS

The invention will be described with reference to the accompanying drawings, wherein like numbers reference like elements.

DESCRIPTION OF EXEMPLARY EMBODIMENTS

An ink jet type printer, for example, will be exemplified as an embodiment of a liquid ejecting apparatus of the invention and described below with reference to the drawings.

First Embodiment

Figure 1:
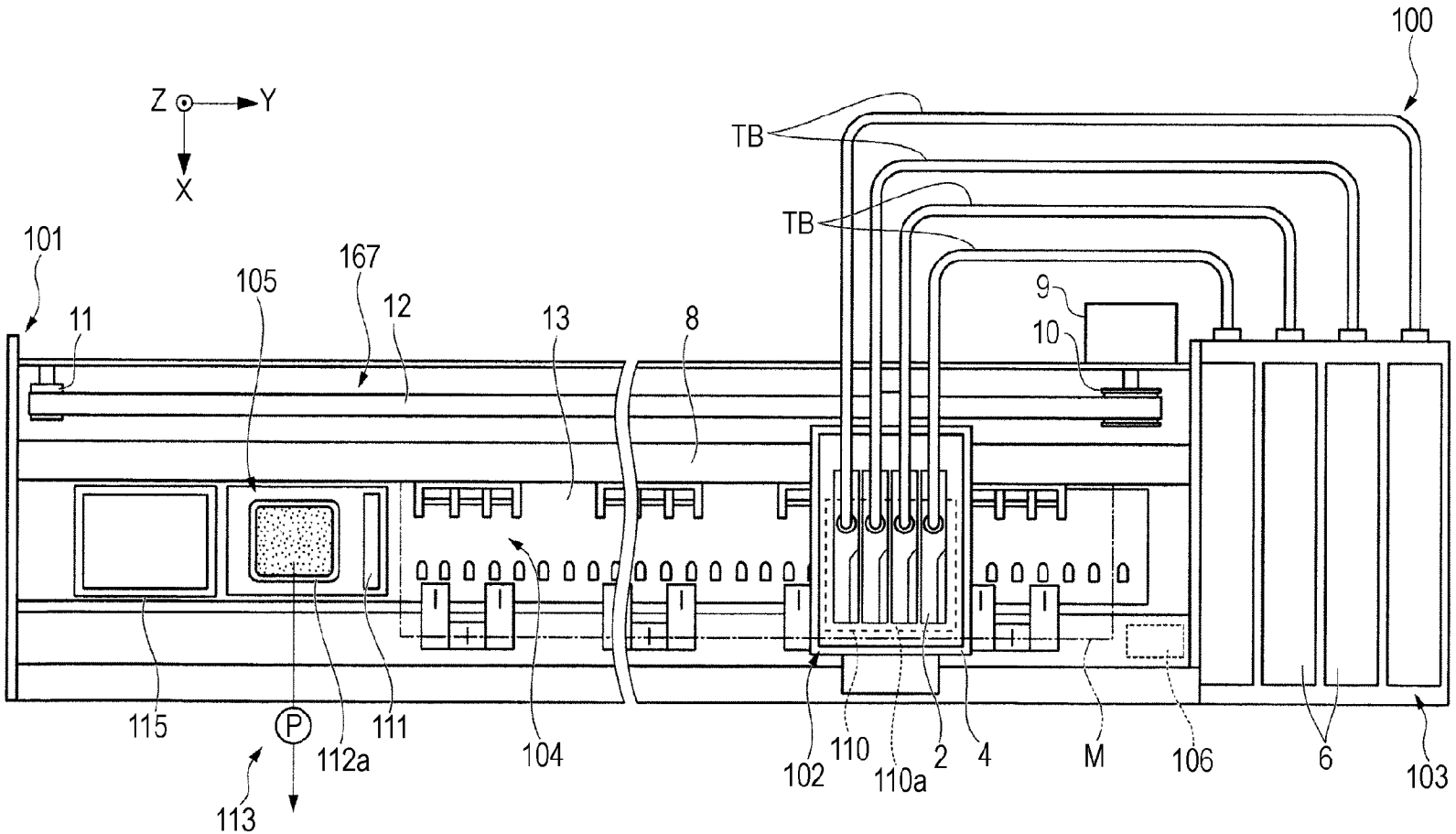
FIG. 1 is a diagram that illustrates the configuration of a printer according to an embodiment.

A printer 100 illustrated in FIG. 1 is an apparatus that performs a printing process while transporting a sheet-like medium M such as, for example, paper or a plastic sheet. The printer 100 includes a housing 101, an ink jet mechanism 102 that ejects ink to the medium M, an ink supply mechanism 103 that supplies ink to the ink jet mechanism 102, a transporting mechanism 104 that transports the medium M, a maintenance mechanism 105 that performs a maintenance operation of the ink jet mechanism 102, and a control apparatus (control unit) 106 that controls each of the mechanisms.

An XYZ orthogonal coordinate system will be set and the positional relationships of each of the constituent elements will be described below with appropriate reference to the XYZ coordinate system. In the embodiment, the ejection direction of the liquid is the Z direction, the movement direction of the head is the Y direction, and the direction that is orthogonal to the Z and Y directions is the X direction.

The housing 101 is formed with the Y direction as the length. Each of the ink jet mechanism 102, the ink supply mechanism 103, the transporting mechanism 104, the maintenance mechanism 105, and the control apparatus 106 is attached to the housing 101. A platen 13 is provided on the housing 101. The platen 13 is a supporting member that supports the medium M. The platen 13 is arranged on the center portion in the X direction of the housing 101. The platen 13 includes a flat face 13*a* that faces the +Z direction. The flat face 13*a* is used as a supporting face that supports the medium M.

The transporting mechanism 104 includes a transport roller, a motor that drives the transport roller, and the like. The transporting mechanism 104 transports the medium M from the −X side of the housing 101 to the inside of the housing 101, and discharges the medium M from the +X side of the housing 101 to the outside of the housing 101. The transporting mechanism 104 transports the medium M so that the medium M passes over the platen 13 inside the housing 101. In the transporting mechanism 104, the timing of the transporting, the transporting amount, and the like are controlled by the control apparatus 106.

The ink jet mechanism 102 includes a head 110 that ejects ink and a head movement mechanism 107 that retains and moves the head 110. The head 110 ejects ink toward the medium M that is sent out onto the platen 13. The head 110 includes an ejection face (nozzle formation face) 110*a* that ejects the ink. The ejection face 110*a* faces the Z direction, and for example, is arranged to oppose the flat face 13*a* of the platen 13.

The head movement mechanism 107 includes a carriage 4. The head 110 is fixed by the carriage 4. The carriage 4 abuts a guide axis 8 that is placed in the longitudinal direction (X direction) of the housing 101. The head 110 and the carriage 4 are arranged in the +Z direction of the platen 13.

Other than the carriage 4, the head movement mechanism 107 includes a pulse motor 9, a driving pulley 10 that is rotationally driven by the pulse motor 9, an idling pulley 11 that is provided on the opposite side in the width direction of the housing 101 with respect to the driving pulley 10, and a timing belt 12 that is connected to the carriage 4 by being suspended between the driving pulley 10 and the idling pulley 11.

The carriage 4 is connected to the timing belt 12. The carriage 4 is provided to be movable in the Y direction along with the rotation of the timing belt 12. When moving in the Y direction, the carriage 4 is guided by the guide axis 8.

The ink supply mechanism 103 supplies ink to the head 110. A plurality of ink cartridges 6 are stored in the ink supply mechanism 103. The printer 100 of the embodiment has a configuration in which the ink cartridges 6 are stored in a position that is different from the head 110 (off carriage type).

The ink supply mechanism 103 includes a supply tube TB that connects the head 110 with the ink cartridges 6. The ink supply mechanism 103 includes a pump mechanism (not shown) that supplies the ink that is stored within the ink cartridges 6 to the head 110 via the supply tube TB.

The maintenance mechanism 105 is arranged at the home position of the head 110. The home position is set in a region that deviates from the region in which printing is performed on the medium M. In the embodiment, the home position is set to the +Y side of the platen 13. The home position is a location at which the head 110 waits when for example, the power of the printer 100 is OFF, when recording is not performed over a long period of time, or when performing maintenance work.

Figure 2B:
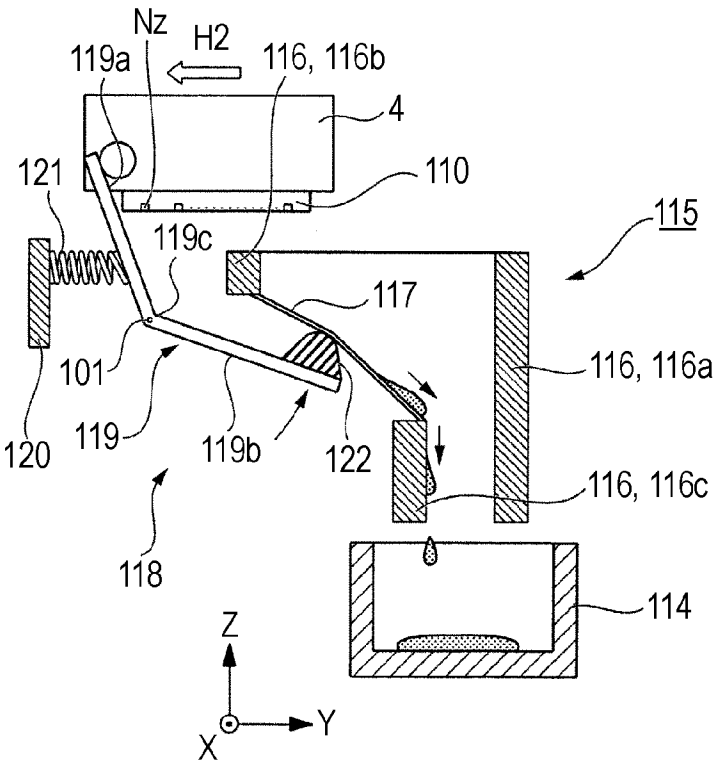
FIGS. 2A and 2B are diagrams that illustrate the configuration of a flushing mechanism.
Figure 2A:
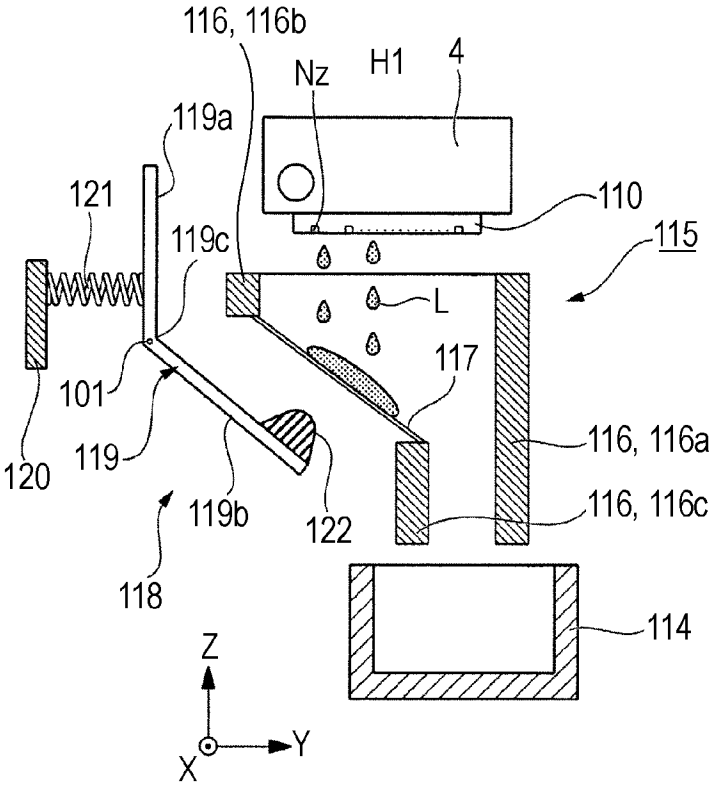

The maintenance mechanism 105 includes a wiping mechanism 111 that wipes the ejection face 110*a* of the head 110, a capping mechanism 112 that covers the ejection face 110*a*, and a flushing mechanism 115 for performing a flushing process of ejecting ink from nozzles NZ of the head 110 (refer to FIGS. 2A and 2B). A suction mechanism 113 such as, for example, a suction pump is connected to the capping mechanism 112. Due to the suction mechanism 113, the capping mechanism 112 is able to suction the space over the ejecting face 110*a*, for example, while covering the ejection face 110*a* of the head 110. The waste ink that is discharged from the head 110 to the maintenance mechanism 105 side is collected, for example, by a waste liquid collection mechanism (not shown).

FIGS. 2A and 2B are diagrams that illustrate the configuration of the flushing mechanism 115, where FIG. 2A illustrates a state in which the head 110 is positioned at a first position and FIG. 2B illustrates a state in which the head 110 is positioned at a second position.

As illustrated in FIGS. 2A and 2B, the flushing mechanism 115 includes an ink receiving unit (liquid receiving unit) 116 that receives ink L that is ejected from the nozzles NZ, a waste ink tank 114 to which the ink received by the ink receiving unit 116 is collected, a deformable sheet-like member 117 that is provided on the ink receiving unit 116 and receives the ink that is ejected from the nozzles NZ, and a deforming unit 118 that deforms the sheet-like member 117.

The ink receiving unit 116 includes one wall along the ejection direction of the ink on the +Y side. Further, the ink receiving unit 116 includes two walls along the ejection direction of the ink on the −Y side which are separated in the Z and Y directions. Furthermore, although not shown, the ink receiving unit 116 includes two walls that are separated in the X direction and formed along the ejection direction of the ink. In addition, the sheet-like member 117 is fixed to two separated walls. In so doing, a member formed by the ink receiving 116 and the sheet-like member 117 includes a space portion that penetrates in the Z direction.

Furthermore, the head 110 side of the penetrating space portion is an opening that is larger than the face of the head 110 on which the nozzles are formed so that the ink L that is ejected from the nozzles NZ can be received. Further, the side away from the head 110 of the penetrating space portion discharges the received ink to the waste ink tank 114. The opening on the head 110 side is larger than the opening on the side away from the head 110.

In the embodiment, both ends of the sheet-like member 117 are fixed to the ink receiving unit 116 by welding, adhesion, or the like in an inclined state (state in which the landing face of the ink is tilted with respect to the ejection direction of the ink). If the sheet-like member 117 is formed by a member that is sheet-like and has flexibility of being deformable by the deforming unit 118, various types such as, for example, a metallic plate, a resin film, or an elastic material such as rubber may be used. In the embodiment, a resin film is used as the configuration material of the sheet-like member 117. Here, a material with absorbability is not appropriate for the application.

The deforming unit 118 is arranged to the opposite side (+Y side) to a region in which printing is performed on the medium M (hereinafter, may be referred to as a printing region) with respect to the ink receiving unit 116, and deforms the sheet-like member 117 linked to the movement of the head 110. That is, the deforming unit 118 deforms the sheet-like member 117 when the head 110 reaches a sheet deforming position (second position) H2 that is set in a direction that is further away from the printing region of a flushing position (first position) H1 where the flushing process of ejecting ink from the nozzles NZ on the ink receiving unit 116 is performed.

The configuration of the deforming unit 118 will be described in detail below. The deforming unit 118 includes a lever unit 119 and a retaining unit 120 that retains the lever unit 119. The lever unit 119 is bent at a center portion 119*c*, the center portion 119*c* is fixed on the retaining unit 120, and one end portion 119*a* and another end portion 119*b* are rotatable with the center portion 119*c* as the center. The other end portion 119*b* includes an abutting portion 122 that abuts the sheet-like member 117. The abutting portion 122 has a convex curvature, and when abutting the sheet-like member 117 as described later, can deform the sheet favorably without causing damage to the sheet-like member 117.

As illustrated in FIG. 2A, the retaining unit 120 supports one end side of a spring member (biasing member) 121, and the other end side of the spring member 121 biases the one end portion 119*a* of the lever unit 119. The lever unit 119 does not abut the head 110 in a case when the head 110 is positioned in the printing region, the flushing position H1, or between the flushing position H1 and the sheet deforming position H2. In such a state, the one end portion 119*a* is arranged to be substantially vertical by being biased by the spring member 121. At this time, the other end portion 119*b* of the lever unit 119 is retained in a position that is away from the sheet-like member 117.

On the other hand, with the lever unit 119, while the head 110 is heading from the flushing position H1 toward the sheet deforming position H2, the opposite face of the retaining face of the one end portion 119*a* by the retaining portion 120 abuts the head 110. As the head 110 moves toward the sheet deforming position H2, the other end portion 119*b* of the lever unit 119 moves in the anti-clockwise direction from the one end portion 119*a* with the center portion 119*c* as the center. That is, the other end portion 119*b* of the lever unit 119 moves toward the sheet-like member 117, and when the head 110 reaches the sheet deforming portion H2, as illustrated in FIG. 2B, the abutting portion 122 provided on the other end portion 119*b* is deformed to be dented in the Z direction by pressing on the center portion of the sheet-like member 117 of which both ends are fixed.

Based on such a configuration, the printer 100 is able to remove the ink that is attached on the sheet-like member 117 by deforming the sheet-like member 117 by the deforming unit 118.

Figure 3:
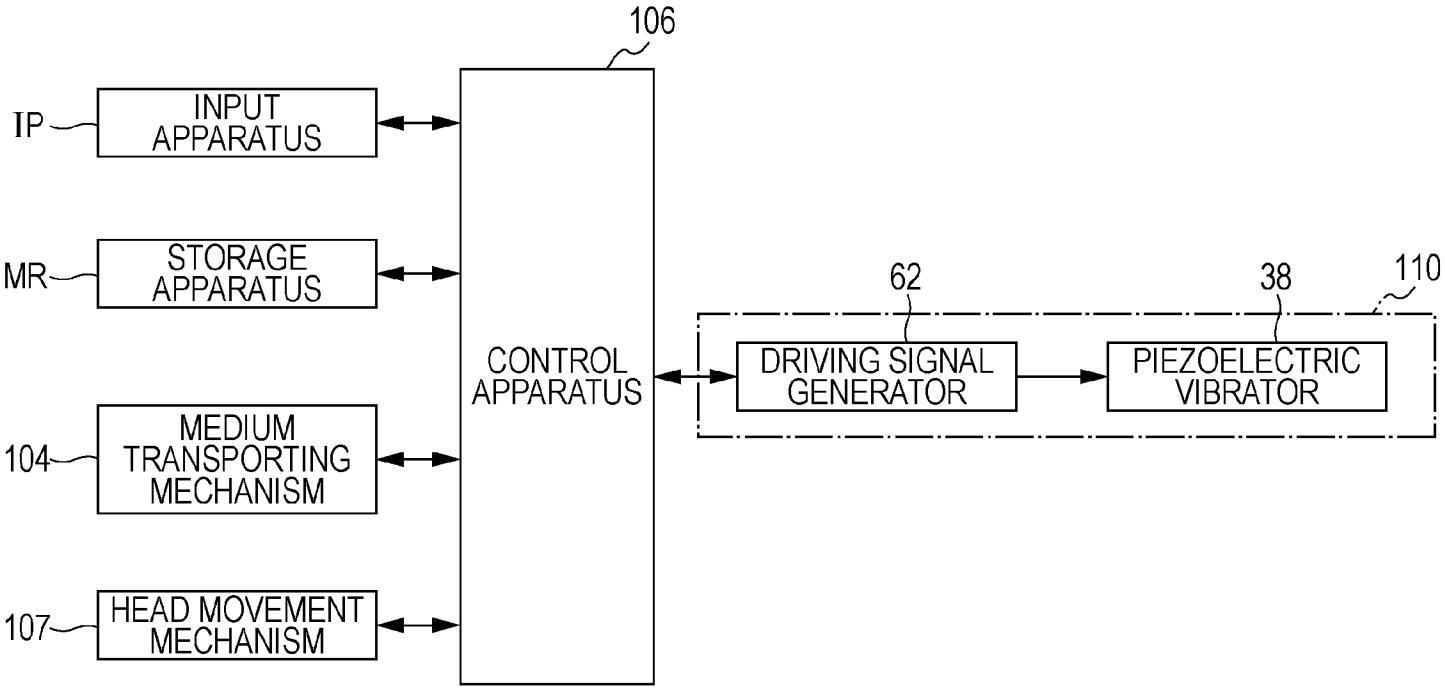
FIG. 3 is a block diagram that illustrates the electric configuration of the printer.

FIG. 3 is a block diagram that illustrates the electrical configuration of the printer 100. The printer 100 includes the control apparatus 106 that controls the overall operation of the printer 100. An input apparatus IP that inputs various pieces of information relating to the operations of the printer 100, a storage apparatus MR in which various pieces of information relating to the operations of the printer 100, and the like are connected to the control apparatus 106, and the transporting mechanism 104, the head movement mechanism 107, the maintenance mechanism 105, and the like described above are connected. The control apparatus 106 can control, for example, the suction mechanism 113 out of the maintenance mechanism 105.

Next, the flushing operation of the printer 100 configured as above will be described.

In a case when a flushing operation is made to be performed, the control apparatus 106 moves the head 110 to the home position, and causes the ejection face 110*a* of the head 110 and the flushing mechanism 115 face each other. Specifically, the control apparatus 106 moves the head 110 to the flushing position H1. The flushing position H1 is a position in which the ejection face 110*a* of the head 110 is arranged to oppose the sheet-like member 117, and is a position in which the ink that is ejected from the head 110 attaches to the sheet-like member 117.

The ink is ejected and discharged from the nozzles NZ at such a position. The discharged ink lands on the sheet-like member 117 that is provided on the ink receiving unit 116. By receiving the ink with the sheet-like member, the ejected ink losing speed due to air resistance, floating, and becoming mist is suppressed. In the embodiment, since the sheet-like member 117 is fixed to the ink receiving unit 116 in a state of being inclined, the ink that lands on the sheet-like member 117 largely pours downward from the surface of the sheet-like member 117 and is collected by the waste ink tank 114 (refer to FIGS. 2A and 2B).

However, in a case when, for example, a pigment ink with high viscosity or an ultraviolet curing type ink is ejected as the ink, even if the sheet-like member 117 is provided in an inclined state, the ink does not easily pour down from the surface of the sheet-like member 117. On the other hand, the printer 100 according to the embodiment reduces the amount of the ink L that remains on the surface of the sheet-like member 117 by deforming the sheet-like member 117 after the ink L is ejected from the nozzles NZ to the sheet-like member 117 and further increasing the angle of inclination. Here, deforming the sheet-like member 117 by the deforming unit 118 in such a manner may be performed for every flushing process, or may be performed following the flushing process executed first after a predetermined amount of time has passed.

Specifically, the control apparatus 106 deforms the sheet-like member 117 by driving the deforming unit 118 by moving the head 110 from the flushing position H1 to the sheet deforming position H2. Here, when ejecting ink from the nozzles NZ to the sheet-like member 117, since one end portion 119*a* of the lever unit 119 is biased by the spring member 121, the other end portion 119*b* of the lever unit 119 is retained at a position away from the sheet-like member 117 (refer to FIG. 2A).

The one end portion 119*a* of the lever unit 119 abuts the head 110 during the movement of the head 110 from the flushing position H1 to the sheet deforming position H2. When the head 110 moves further, the abutting portion 122 provided on the other end portion 119*b* of the lever unit 119 moves toward the sheet-like member 117 with the center portion 119*c* as the center. Furthermore, when the head 110 reaches the sheet deforming position H2, the sheet-like member 117 is deformed so that the vicinity of the center of the sheet-like member 117 is bent by being pressed by the abutting portion 122 (refer to FIG. 2B). In other words, the shape of sheet-like member 117 is deformed with respect to the shape of receiving the ink (FIG. 2A). Here, since the abutting portion 122 has a convex curvature, the sheet can be deformed favorably without damaging the sheet-like member 117.

Since the sheet-like member 117 that is deformed by being pressed by the abutting portion 122 in such a manner is sharply deformed according to the shape of the abutting portion 122 and the angle of the inclination is large, the ink that is attached to the sheet-like member 117 can be removed by sliding the ink from the surface of the sheet-like member 117 down into the ink receiving unit 116. There is therefore no need to separately provide a mechanism for performing a cleaning process of cleaning the sheet-like member 117.

However, even if the sheet-like member 117 is deformed, it is difficult to completely remove the attached ink. The reason is that the ink remains on the sheet-like member 117 as a thin film. In a case when the power of the printer 100 is turned OFF or in a case when a printing process is not performed over a long period of time in such a state, the ink L that is attached to the surface of the sheet-like member 117 may solidify and create a solidified film. Furthermore, ink that is flushed thereafter attaches to the solidified film. The ink then does not easily run off compared to when the ink is attached to the sheet-like member. The ink that remains therefore increases further and gradually builds up. Although there was a need to carve off such a solidified film in the related art, it was difficult to carve off solidified materials that have formed a thin film, and further, in terms of space, it was difficult to provide a scraping mechanism on a portion that is flushed.

Figure 4A:
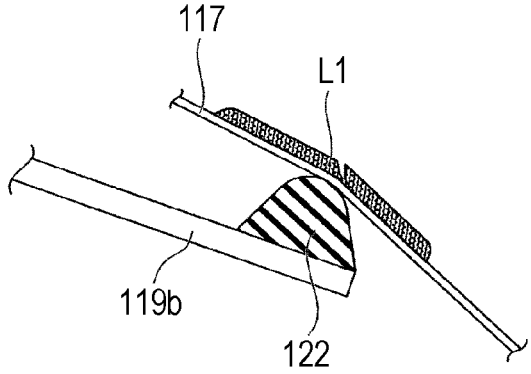
FIGS. 4A to 4C are diagrams for describing the deforming operation of a sheet-like member.
Figure 4B:
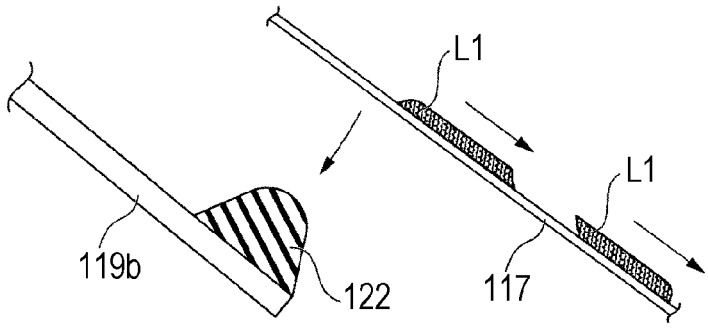

In the application, in such a case, the printer 100 is able to detach the solidified film from the surface of the sheet-like member 117 by driving the deforming unit 118 by directly moving the head 110 to the sheet deforming portion H2 and deforming the sheet-like member 117. Specifically, if the sheet-like member 117 is pressed by the abutting portion 122 from the opposite side of the face on which the ink is attached to the direction of the face on which the ink is attached, as illustrated in FIG. 4A, the sheet-like member 117 is curved according to the shape of the abutting portion 122. Since with a solidified film L1 that is positioned further to the outside from the curved sheet-like member 117, the deforming amount is increased since before the curving, the solidified film L1 that is attached to the surface of the sheet-like member 117 is cracked. Although there is only one crack in the drawing, since in reality cracks appear on a plurality of locations, it is easier for the solidified film L1 to become detached from the sheet-like member 117. Furthermore, when the abutting portion 122 moves away and the sheet-like member 117 returns to a flat state, the cracked solidified film L1 slides down by its own weight from the surface of the sheet-like member 117 that is fixed in an inclined state as illustrated in FIG. 4B and is collected within the waste ink tank 114.

Figure 4C:
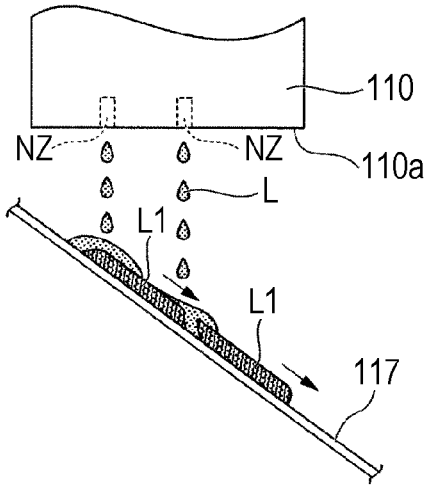

Here, after the sheet-like member 117 is deformed, the printer 100 moves the head 110 to the flushing position H1, and as illustrated in FIG. 4C, and the ink L may be ejected from the nozzles NZ to the sheet-like member 117 of the ink receiving unit 116. In so doing, even in a case when fragments of the solidified film L1 that is cracked by deforming the sheet-like member 117 as described above remain on the sheet surface, by flushing the fragments of the solidified film L1 downward along with the ink ejected from the nozzles NZ, the fragments can be collected in the waste ink tank 114.

As described above, according to the printer 100 according to the embodiment, by the deforming unit 118 deforming the sheet-like member 117, the ink that is attached to the sheet-like member 117 can be removed without performing a cleaning process. Further, even in a case when the ink that is attached to the sheet-like member 117 solidifies and a solidified film is created, the solidified film can be detached from the sheet-like member by the deforming unit 118 deforming the sheet-like member 117 and cracking the solidified film. It is therefore possible to remove the ink from the sheet-like member 117 without performing a cleaning process of the sheet-like member 117, and it is possible to prevent the occurrence of an inconvenience in which the ink solidifies and accumulates on the sheet-like member 117.

Further, in the embodiment, since the sheet-like member 117 is fixed to the ink receiving unit 116 in an inclined state, when the sheet-like member 117 is deformed, it is possible to slide the ink or the solidified film L1 on the sheet-like member 117 by its own weight, and it is possible to perform removal of the ink easily.

Further, in the embodiment, since the deforming unit 118 deforms the sheet-like member 117 linked with the movement of the head 110, there is no need to use another power mechanism as the deforming unit 118, and the apparatus configuration of the printer 100 can be simplified. Since the deforming unit 118 can deform the sheet-like member 117 by the lever unit 119 that moves along with the movement of the head 110, the apparatus configuration can be simplified and an increase in costs can be prevented. Further, since the abutting portion 121 has a convex curvature, the sheet can be favorably deformed without damaging the sheet-like member 117.

Further, in the embodiment, since the deforming unit 118 is arranged to the opposite side of the printing region with respect to the ink receiving unit 116, the lever unit 119 does not abut the sheet-like member 117 unless the head 110 moves from the flushing position H1 to the sheet-deforming position H2. Therefore, when the head 110 performs a regular printing process, even when the head 110 moves within the printing region along the guide axis 8, it is possible to prevent the occurrence of an inconvenience such as an operation noise or an abnormal noise being generated by the lever unit 119 abutting the sheet-like member 117 a plurality of times.

Second Embodiment

Next, a second embodiment according to the invention will be described. The difference between the present embodiment and the embodiment described above is the structure of the ink supply system and the structure of deforming the sheet-like member 117 that is fixed to the ink receiving unit 116 of the flushing mechanism 115, and other configurations are the same. Therefore, the structure of the ink supply system and the structure of deforming the sheet-like member 117 will mainly be described below, and detailed description of other configurations will be omitted or simplified.

Figure 5:
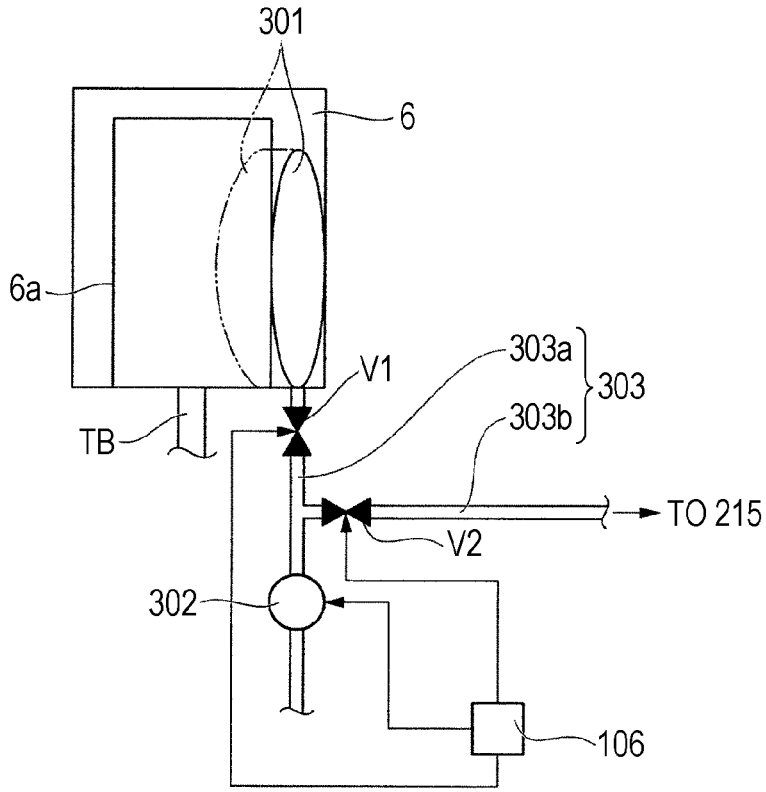
FIG. 5 is a diagram that illustrates the structure of an ink supply system according to a second embodiment.

FIG. 5 is a diagram that illustrates the configuration of an ink supply system of the printer 100 according to the embodiment.

As illustrated in FIG. 5, the printer 100 according to the embodiment includes a supply system 300 that supplies ink to the head 110 side via the supply tube TB by pressuring ink packs 6*a* that are provided within the ink cartridge 6. The supply system 300 includes a pinch-and-swell member 301 that can pressurize the ink packs 6*a* by pinching and swelling, a pump 302, and a transport tube 303 that transports the air sent by the pump 302 to the pinch-and-swell member 301. Here, the pump 302 is electrically connected to the control apparatus 106, and the driving thereof is controlled by the control apparatus 106.

The pump 302 has a structure of being able to be atmospherically released. In so doing, the supply system 300 is able to supply ink by efficiently pressure feeding the ink from the ink packs 6*a* to the head 110 via the supply tube TB by repeating an operation in which the pinch-and-swell member 301 that is swelled by supplying compressed air via the transport tube 303 pressurizes the ink packs 6*a* and an operation of the pinch-and-swell member 301 that pressurizes the ink packs 6*a* shrinking by an atmospheric release.

Further, the transport tube 303 includes two diverging portions 303*a* and 303*b*, and valves V1 and V2 are provided on each diverging portion 303*a* and 303*b*. The valves V1 and V2 are electrically connected to the control apparatus 106 so that the opening and closing operation of each is controlled. The pinch-and-swell member 301 is connected to one end side of the diverging portion 303*a* and connected to a portion of a flushing mechanism 215 described later on one end side of the diverging portion 303*b*.

When supplying ink from the ink packs 6*a* to the head 110, the control apparatus 106 drives the pump 302 in a state in which the valve V1 is opened and the valve V2 is closed. On the other hand, the control apparatus 106 is able to supply compressed air to the flushing mechanism 215 side by driving the pump 302 in a state in which the valve V1 is closed and the valve V2 is opened.

Figure 6B:
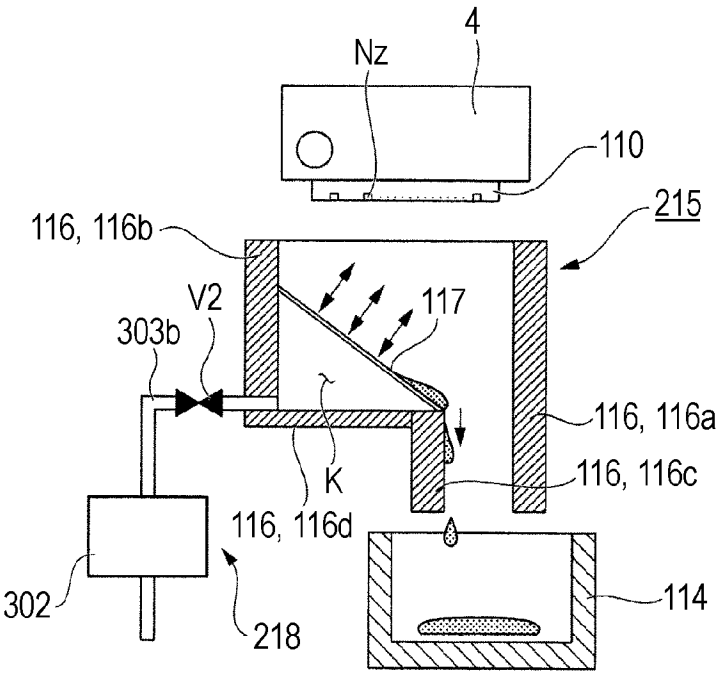
FIGS. 6A and 6B are diagrams that illustrate the configuration of a flushing mechanism according to the second embodiment.
Figure 6A:
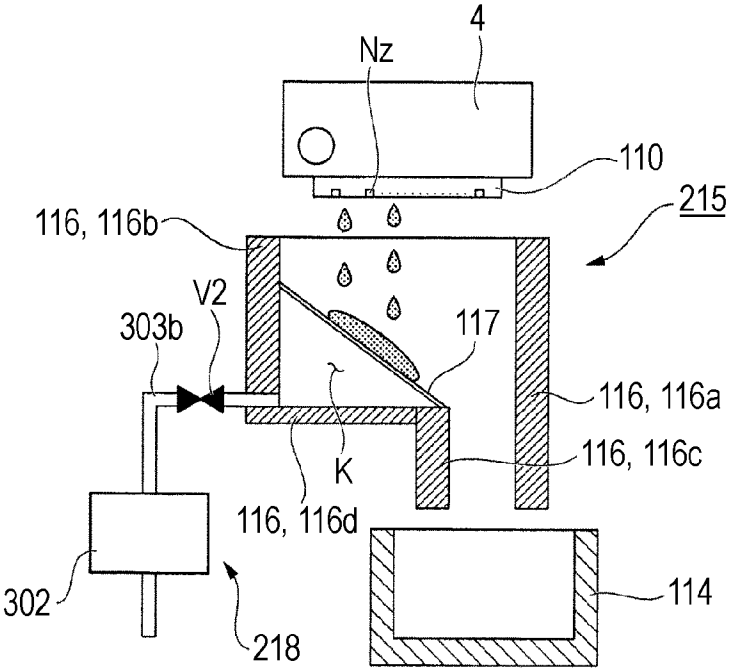

FIGS. 6A and 6B are diagrams that illustrate the configuration of the flushing mechanism 215 according to the embodiment.

As illustrated in FIG. 6A, the flushing mechanism 215 includes the ink receiving unit 116 that receives the ink that is ejected from the nozzles NZ, the waste ink tank 114 at which the ink that is received by the ink receiving unit 116 is collected, the sheet-like member 117 that is provided on the ink receiving unit 116, receives the ink that is ejected from the nozzles NZ, and that is deformable, and a deforming unit (pressure changing unit) 218 that deforms the sheet-like member 117.

The ink receiving unit 116 includes one wall 116*a* along the ejection direction of the ink on the +Y side. Furthermore, on the −Y side, the ink receiving unit 116 includes two walls 116*b* and 116*c* along the ejection direction of the ink which are separated in the Z and Y directions. Further, the ink receiving unit 116 includes a base plate 116*d* that connects the walls 116*b* and 116*c*. Furthermore, although not shown in the drawings, the ink receiving unit 116 includes two walls formed along the ejection direction of the ink that are separated in the X direction. In addition, all of the outer circumference portions of the sheet-like member 117 are fixed to the walls 116*b* and 116*c* and the two walls formed along the ejection direction of the ink which are separated in the X direction. In so doing, a member formed by the ink receiving unit 116 and the sheet-like member 117 includes a space portion that penetrates in the Z direction.

Furthermore, the head 110 side of the penetrating space portion is an opening that is larger than the face of the head 110 on which the nozzles are formed so that the ink L that is ejected from the nozzles NZ can be received. Further, the side away from the head 110 of the penetrating space portion discharges the received ink to the waste ink tank 114. The opening on the head 110 side is larger than the opening on the side away from the head 110.

The head 110 of the sheet-like member 117 and the ink receiving unit 116 on the opposite side configure a pressure-receiving space K.

The deforming unit 218 configures a pressure changing unit that deforms the sheet-like member 117 by changing the pressure on an opposite face side (hereinafter, referred to as the back face side) that is opposite to an ejection face 117*a* with respect to the ejection face 117*a* side (hereinafter, referred to as the front face side) of the sheet-like member 117 to which the ink is ejected.

Specifically, the deforming unit 218 according to the embodiment changes the pressure on the front face side and the back face side of the sheet-like member 117 by using the pump 302 of the supply system 300 connected via the diverging portion 303*b* as the motive power source and creating a pressurized state by supplying pressurized air to the pressure-receiving space K in an atmospheric pressure state or atmospherically releasing the pressure-receiving space K and creating an atmospheric pressure state, and causes the sheet-like member 117 to be deformable in the direction of the arrow illustrated in FIG. 6B.

Based on such a configuration, the printer 100 is able to remove the ink that is attached to the sheet-like member 117 by deforming the sheet-like member 117 by the deforming unit 218.

In a case when a flushing operation is made to be performed, the control apparatus 106 moves the head 110 to the home position and causes the ejection face 110*a* of the head 110 and the flushing mechanism 115 to be in an opposing state. Specifically, the control apparatus 106 moves the head 110 to the flushing position H1. The flushing position H1 is a position at which the ejection face 110*a* of the head 110 is arranged to be opposing on the sheet-like member 117, and is a position at which the ink that is ejected from the head 110 attaches to the sheet-like member 117.

The ink is ejected and discharged from the nozzles NZ at such a position. The discharged ink lands on the sheet-like member 117 that is provided on the ink receiving unit 116. By receiving the ink with the sheet-like member, the ejected ink losing speed due to air resistance, floating, and becoming mist is suppressed.

The printer 100 according to the embodiment reduces the amount of the ink L that remains on the surface of the sheet-like member 117 by deforming the sheet-like member 117 and increasing the angle of the inclination further after the ink L is ejected from the nozzles NZ to the sheet-like member 117.

Specifically, the control apparatus 106 creates a pressurized state by driving the pump 302 in a state in which the valve V1 is closed and the valve V2 is opened and by supplying pressurized air to the pressure-receiving space K via the diverging portion 303*b*. Since the end portions of the sheet-like member 117 are fixed, the center portion swells. In so doing, the inclination of the sheet-like member 117 becomes steep and the ink that is ejected to the sheet-like member 117 flows down. The sheet-like member 117 that had been swelled by creating an atmospheric pressure state by atmospherically releasing the pressure-receiving space K then returns to the original state. By the above, the sheet-like member 117 can be deformed by changing the pressure on the front face side and the back face side of the sheet-like member 117 (refer to FIG. 6B).

In such a manner, even with the embodiment, the ink that is attached to the sheet-like member 117 can be removed by sliding down the ink from the surface of the sheet-like member 117 that is deformed by the deforming unit 218 into the ink receiving unit 116. Further, according to the printer 100 according to the embodiment, the solidified film can be detached from the surface of the sheet-like member 117 by deforming the sheet-like member 117 by the deforming unit 218.

Modification

Figure 7:
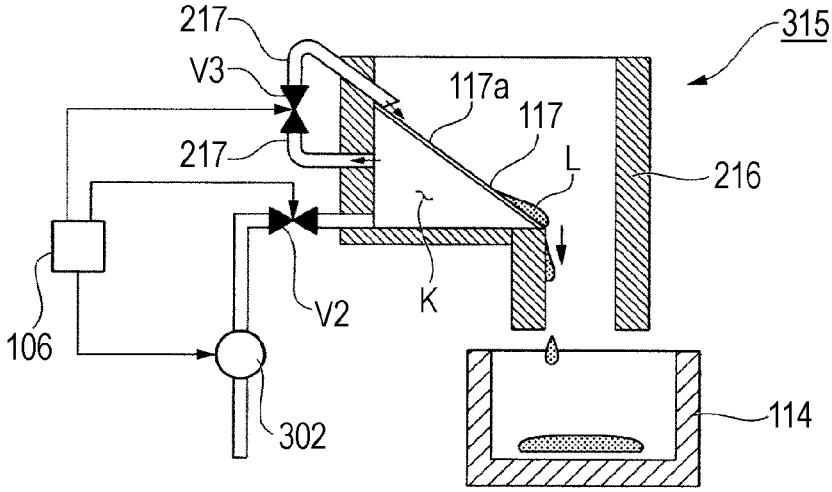
FIG. 7 is a diagram that illustrates the configuration according to a modification of the flushing mechanism.

Next, a modification according to the second embodiment according to the invention will be described. FIG. 7 is a diagram that illustrates the configuration of a flushing mechanism 315 according to the modification. As illustrated in FIG. 7, the flushing mechanism 315 includes an ink receiving unit 216, the waste ink tank 114, the sheet-like member 117, and the deforming unit 218 that deforms the sheet-like member 117. A Communicating portion 217 that communicates the pressure-receiving space K that is formed between the sheet-like member 117 and the ink receiving unit 116 with the space in the vicinity of the ejection face 117*a* (front face) of the sheet-like member 117 is formed on the ink receiving unit 216, and a blocking valve V3 as a communicating portion valve that can block the communicating portion 217 is provided on the communicating portion 217. Here, the blocking valve V3 is electrically connected to the control apparatus 106 so that the opening and closing operation thereof is controlled.

The operations of the printer according to the modification will be described below.

The control apparatus 106 is able to remove the ink L that is attached to the sheet-like member 117 by deforming the sheet-like member 117 to be convex by sending pressurized air into the pressure-receiving space K by driving the deforming unit 218 and sliding down the ink L from the surface of the sheet-like member 117 into the ink receiving unit 116 in a state in which the blocking valve V3 is closed after the ink is ejected onto the sheet-like member 117 from the nozzles NZ by a flushing process.

Next, the control apparatus 106 opens the blocking valve V3 without atmospherically releasing the pump 302. In so doing, the compressed air within the pressure-receiving space K is ejected by being guided to the ejection face 117*a* via the communicating unit 217. Therefore, even in a case when the ink L remains on the sheet-like member 117, the ink L can be reliably removed by ejecting air to the ejection face 117*a* as described above. Further, in a case when the sheet-like member 117 is deformed with respect to solidified ink and the solidified film cracks and detaches but does not slide down, the solidified film can be blown away by the ejected compressed air.

Here, the invention is not limited to the embodiments described above, and can be appropriately changed within a range that does not depart from the gist of the invention. For example, although a case in which the deforming units 118 and 218 deform the same location of the sheet-like member 117 has been described in the embodiments described above, the invention is not limited thereto. Specifically, it is desirable that the deforming units 118 and 218 change the deforming position of the sheet-like member 117 from the upper side toward the lower side. For example, the deforming position of the sheet-like member 117 may be changed by providing a movable roller mechanism in a state of abutting the sheet-like member 117 instead of the abutting portion 121 of the lever unit 119 of the deforming unit 118. Further, the deforming position of the sheet-like member 117 may be changed by changing the direction in which compressed air is supplied into the pressure-receiving space K by the deforming unit 218.

Figure 8:
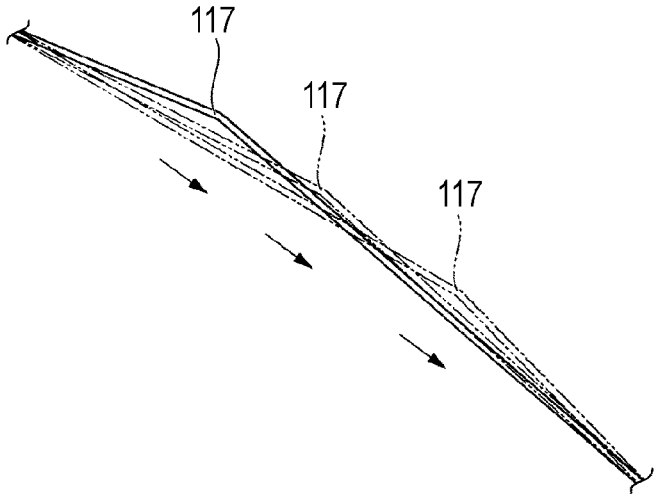
FIG. 8 is a diagram that illustrates a modification of the sheet-like member according to a modified method.

According to such a configuration, as illustrated in FIG. 8, since the sheet-like member 117 is deformed from the upper side toward the lower side, the ink on the sheet-like member 117 can be favorably removed by being slid downward.

Further, the deforming units 118 and 218 may change the deforming amount of the sheet-like member 117 according to the timing at which the sheet-like member 117 is deformed. For example, the deforming amount of the sheet-like member 117 is changed between a case when the sheet-like member 117 is deformed after ink is ejected from the nozzles NZ onto the sheet-like member 117 by a flushing process and a case when the sheet-like member 117 is deformed before the ink is ejected onto the sheet-like member 117.

Specifically, the deforming amount is increased compared to the deforming amount in a case when the sheet-like member 117 is deformed after a long period of time has passed such as in a case when the power of the printer 100 is OFF with respect to the deforming amount in a case when the sheet-like member 117 is deformed immediately after the flushing process. In other words, the longer the amount of time since the sheet-like member 117 has received the ink, the greater the deforming amount of the sheet-like member 117.

The reason is that in a case when the sheet-like member 117 is to be deformed immediately after the flushing process, since the ink on the sheet-like member 117 has not solidified, the ink can be slid down from the sheet-like member 117 even if the deforming amount of the sheet-like member 117 is decreased. Conversely, in a case when the sheet-like member 117 is to be deformed after a long period of time has passed, there is a concern that the ink that is attached to the surface of the sheet-like member 117 solidifies to be film-like, the reason being that the solidified film can be reliably removed by increasing the deforming amount of the sheet-like member 117.

Here, deforming in the application is to dent or curve the sheet-like member of which both ends are fixed so that the side of the sheet-like member on which the ink is attached becomes the outside. In other words, the shape is changed with respect to the shape when the sheet-like member receives the ink that is flushed. It is not that the sheet-like member is simply moved or the biasing is changed without changing the shape of the sheet-like member.

Further, although the liquid ejecting apparatus of the invention is applied to an ink jet printer in the embodiments described above, the liquid ejecting apparatus may be applied to a liquid ejecting apparatus that ejects or discharges liquids other than ink. That is, the liquid ejecting apparatus can be applied to various liquid ejecting apparatuses that include a liquid ejecting head that discharges minute amounts of droplets or the like. Here, a droplet refers to the state of a liquid that is discharged from the above liquid ejecting apparatus, and includes those that are a dot shape, a tear shape, or a string shape leaving a trail. Further, the liquid referred to here may be made by any material that can be ejected by the liquid ejecting apparatus.

For example, it is sufficient if the material is in a liquid state, and may not only be a liquid state of high or low viscosity, sol, gel water, other flowing states such as an inorganic solvent, an organic solvent, a solution, a liquid resin, or a liquid metal (metallic melt), or a liquid of one-state material, but also those in which particles of the functioning materials composed of solids such as pigments and metal particles are dissolved, dispersed, or mixed in a solvent and the like are included. Further, as a typical example of the liquid, ink as described in the above embodiments is exemplified. Here, ink includes various liquid compositions such as general water-based inks and oil-based inks as well as gel ink and hot melt ink.

As a specific example of the liquid ejecting apparatus, a liquid ejecting apparatus that ejects a liquid that disperses or includes in a dissolved form a material such as an electrode material or a color material that is used in the manufacture or the like of a liquid crystal display, an EL (electroluminescence) display, a surface-emitting display, or a color filter, for example, a liquid ejecting apparatus that ejects a bio-organic material that is used in the manufacture of biochips, a liquid ejecting apparatus that is used as a precision pipette and that ejects a liquid that is used as a sample, a printing apparatus, a microdispenser, and the like are exemplified.

Furthermore, a liquid ejecting apparatus that ejects a lubricant to a precision instrument such as a clock or a camera with pinpoint accuracy, a liquid ejecting apparatus that ejects a transparent resin solution such as an ultraviolet curable resin for forming a microscopic hemisphere lens (optical lens) that is used in optical communication devices and the like, or a liquid ejecting apparatus that ejects an acidic or alkaline etching liquid for etching a substrate or the like may be adopted.

What is claimed is:

1. A liquid ejecting apparatus comprising: a liquid ejecting head that includes a plurality of nozzles that eject a liquid; a liquid receiving unit that receives the liquid that is ejected from the nozzles on the liquid ejecting head while having a deformable sheet-like member fixed thereto; and a deforming unit that deforms the sheet-like member wherein the liquid receiving unit, deformable sheet-like member, and deforming unit are set in a region of the ejecting apparatus that is separate from a print region or a print medium transportation path.

2. The liquid ejecting apparatus according to claim 1, wherein the deforming unit changes a shape of the sheet-like member when the sheet-like member receives the liquid.

3. The liquid ejecting apparatus according to claim 2, wherein the deforming unit deforms the sheet-like member in a direction from an opposite side to a face in which the sheet-like member receives the liquid to a face side that receives the liquid.

4. The liquid ejecting apparatus according to claim 3, wherein the deforming unit includes an abutting portion that abuts from an opposite side to a face in which the sheet-like member receives the liquid.

5. The liquid ejecting apparatus according to claim 1, wherein the deforming unit makes an amount by which the sheet-like member is deformed changeable.

6. The liquid ejecting apparatus according to claim 5, wherein the deforming unit includes a lever unit in which one end portion can abut when the liquid ejecting head is moved, and the abutting portion that is positioned at another end portion deforms the sheet-like member when the lever unit moves to a second position that is different from a first position in which the liquid ejecting head ejects the liquid from the nozzles to the liquid receiving unit.

7. The liquid ejecting apparatus according to claim 3, further comprising: a pressure changing unit that deforms the sheet-like member by changing a pressure of an opposite face side that is opposite to an ejection face to which the liquid is ejected in the sheet-like member.

8. The liquid ejecting apparatus according to claim 7, wherein the pressure changing unit pressurizes or atmospherically releases a pressurized space that is formed by the sheet-like member and the liquid receiving unit.

9. The liquid ejecting apparatus according to claim 8, wherein a communicating portion that leads pressurized air of the pressurized space to the ejection face of the sheet-like member is formed on the liquid receiving unit and a communicating portion valve that can open and close the communicating portion is provided on the communicating portion.

10. The liquid ejecting apparatus according to claim 9, further comprising: a pump that pressurizes the pressurized space; a supply unit that supplies pressurizing force from the pump to the pressurized space; and a supply valve that can open and close the supply unit, wherein after pressurizing the pressurized space by releasing the supply unit valve and driving the pump in a state in which the communicating unit valve is closed, the supply valve is closed and the communicating portion valve is released.

11. The liquid ejecting apparatus according to claim 1, wherein the deforming unit deforms a region in which the sheet-like member receives the liquid at a position in which the sheet-like member receives the liquid.

* * * * *